US006354590B1

(12) United States Patent
Payne

(10) Patent No.: US 6,354,590 B1
(45) Date of Patent: Mar. 12, 2002

(54) ROTARY BIN SORTER

(75) Inventor: David M. Payne, Meridian, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/425,116

(22) Filed: Oct. 20, 1999

(51) Int. Cl.[7] ..... B65H 39/10
(52) U.S. Cl. ..... 271/295; 271/279
(58) Field of Search ..... 271/279, 284, 271/295, 9.13, 9.08; 270/58.21, 58.22

(56) References Cited

U.S. PATENT DOCUMENTS 3,076,647 A * 2/1963 Lowe et al. ..... 271/295
3,096,089 A * 7/1963 Swenker et al. ..... 271/295
3,575,408 A * 4/1971 Cole ..... 270/58.22
3,804,005 A * 4/1974 Burger et al. ..... 270/58.21
3,851,872 A * 12/1974 Gerbasi ..... 271/295
4,542,818 A * 9/1985 Pavie ..... 241/315
4,582,421 A * 4/1986 Hamlin et al. ..... 271/295
5,556,087 A * 9/1996 Gosslinghoff ..... 271/295

* cited by examiner

*Primary Examiner*—H. Grant Skaggs

(57) ABSTRACT

A multiple bin sorter for use with an image forming device in which the bins rotate through a sheet receiving position and, as may be necessary or desirable, through other positions to accommodate a variety of different finishing operations. The sorter includes a plurality of rotatable bins configured to receive sheets outputted by an image forming device.

1 Claim, 8 Drawing Sheets

ROTARY BIN SORTER

FIELD OF THE INVENTION

The invention relates generally to multiple bin output sorters for printers and copiers and, more particularly, to a rotary bin sorter.

BACKGROUND

The invention was conceived in an effort to provide a less complex and more reliable and robust multiple bin sorter for printers, copiers and other image forming machines. Conventional multiple bin sorters use a series of vertically stacked bins or trays positioned at the side of the printer. Some sorters utilize a reversible motor that turns a spiral cam or other suitable transmission device to drive the bins up and down to align the proper bin with the printer output. Other sorters use sliding paper diverters that direct each sheet to the proper bin or, for some of the larger sorters, a paper transport system that conveys each sheet to the proper bin. The bins are oriented near horizontal in all of these conventional systems. Paper diverter and transport systems tend to be mechanically complex and lightly built and sometimes prone to paper jams and breakdowns.

SUMMARY

The present invention is directed to a multiple bin sorter in which the bins rotate through a sheet receiving position and, as may be necessary or desirable, through other positions to accommodate a variety of different finishing operations. The rotary bin sorter of the present invention can be designed more compact, mechanically less complex and more reliable and robust than conventional sliding paper bins, paper diverters and transport systems. The rotary sorter is also advantageous because the edges of the pages in multiple page print jobs can be automatically straightened or justified under the variety of forces that may be exerted on the paper (e.g., centrifugal force, gravity, vibration and mechanical acceleration and deceleration) as the bins rotate.

The sorter includes a plurality of rotatable bins configured to receive sheets outputted by an image forming device. Typically, the bins will be rotated by a motor, preferably a stepper motor. The motor may be mounted to a sorter housing for stand alone units. Alternatively, the motor may be mounted in the image forming device for sorters that are attached to and integrated with the image forming device. It is expected that the bins will most often be configured as rectangular boxes open on at least one side. Sheets output by the image forming device are received through the open side of each bin. In this embodiment, the bins extend out from an axis of rotation in the general configuration of a wheel. The bins may be arranged so that narrow sides or broad sides of the bins lie in the plane of the wheel. The axis of rotation may be oriented vertically or horizontally. The axis may extend in the same direction as the path of sheets outputted by the image forming machine or in a direction perpendicular to the path of sheets outputted by the image forming machine.

DETAILED DESCRIPTION

The invented sorter is designed for use with or as an integrated part of any printer, copier or other image forming device in which it may be desirable to utilize the capabilities of a multiple bin sorter. Accordingly, it is to be understood that the following description and the drawings illustrate only a few exemplary embodiments of the invention. Other embodiments, forms and details may be made without departing from the spirit and scope of the invention, which is expressed in the claims that follow this description.

Figure 1:
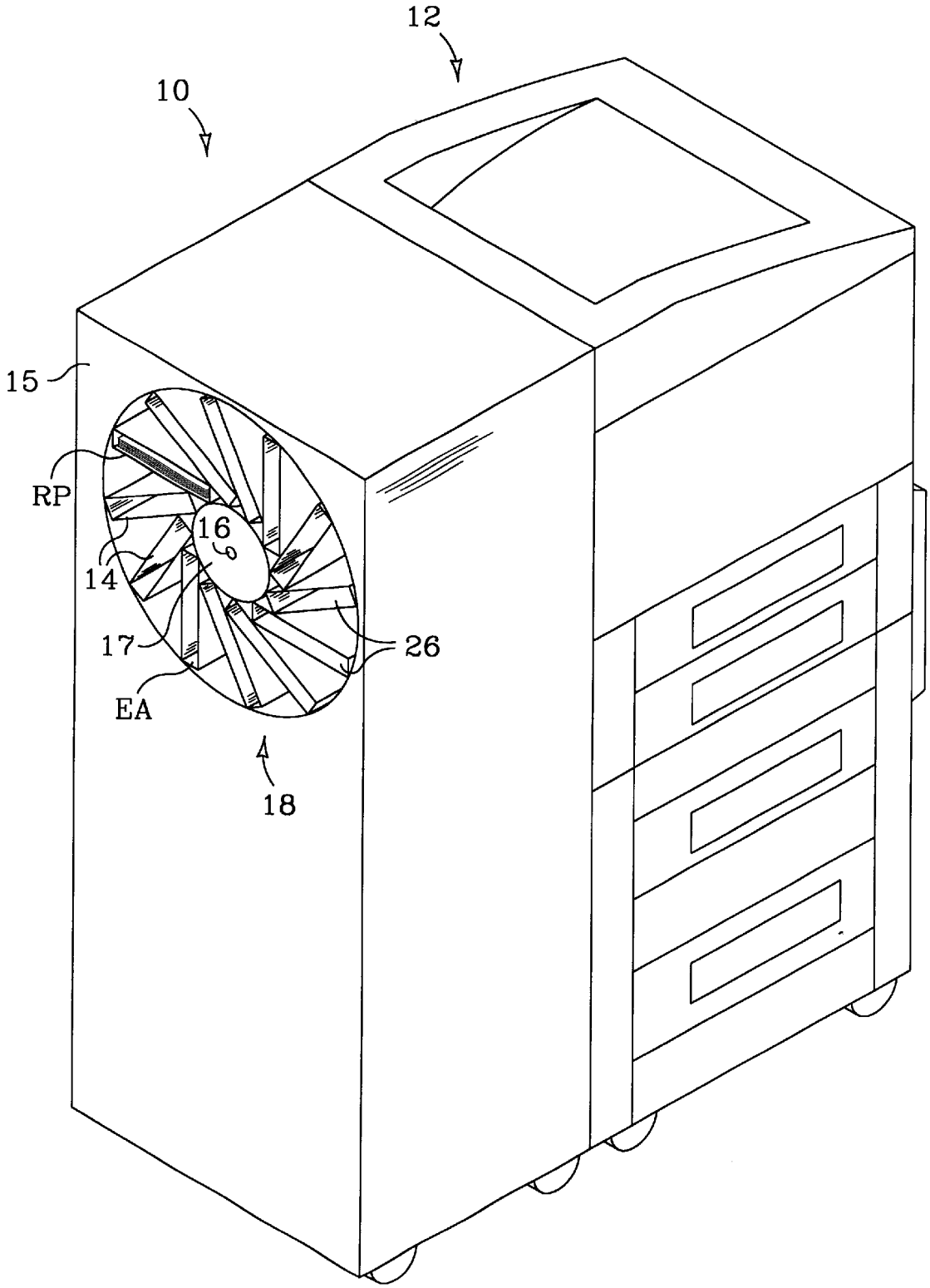
FIG. 1 is an isometric view of one embodiment of the invented rotary bin sorter in which the sorter is a stand alone unit operatively coupled to a printer.
Figure 2:
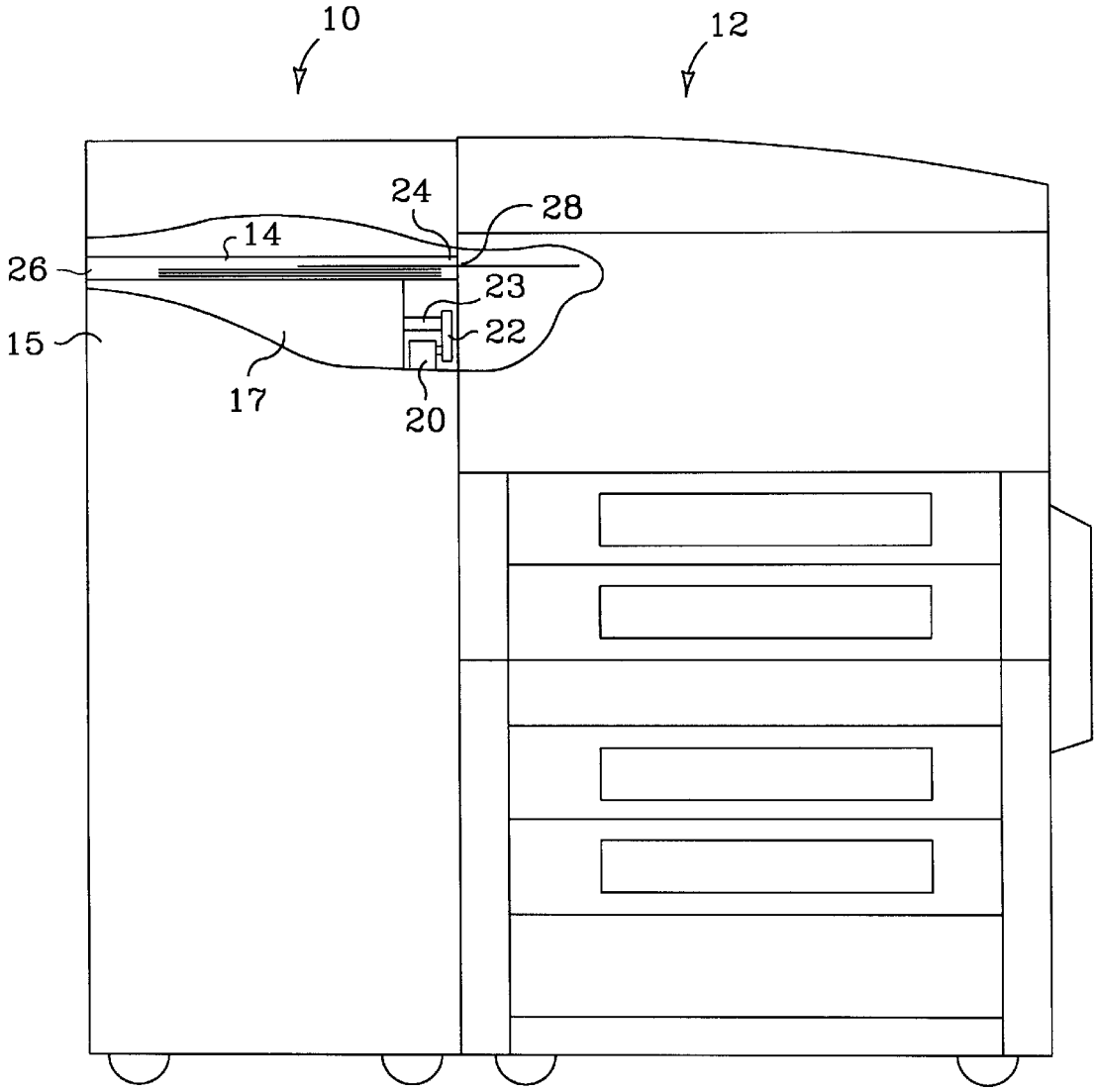
FIG. 2 is a front elevation view of the sorter of FIG. 1.
Figure 3:
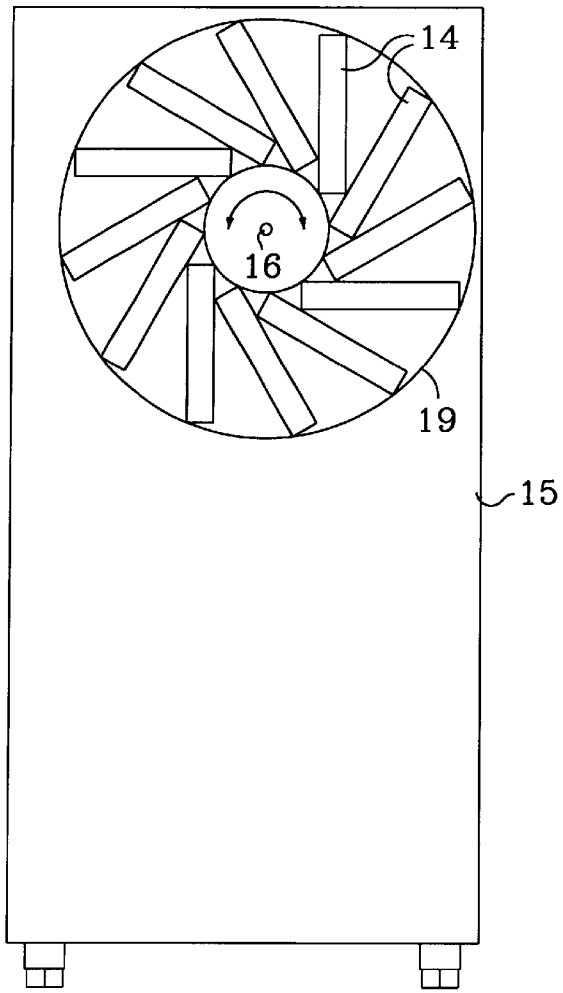
FIG. 3 is a side elevation view of the sorter of FIG. 1.

FIG. 1 shows a rotary bin sorter 10 attached to printer 12. In the embodiment of FIG. 1, sorter 10 is a stand alone unit that is operatively coupled to printer 12. In the embodiment shown in FIG. 3, which is discussed later in this description, sorter 10 is integrated into printer 12 such that some of the operational components of sorter 10 are built into printer 12. FIGS. 2 and 3 are front and side elevation views of the sorter of FIG. 1.

Figure 9:
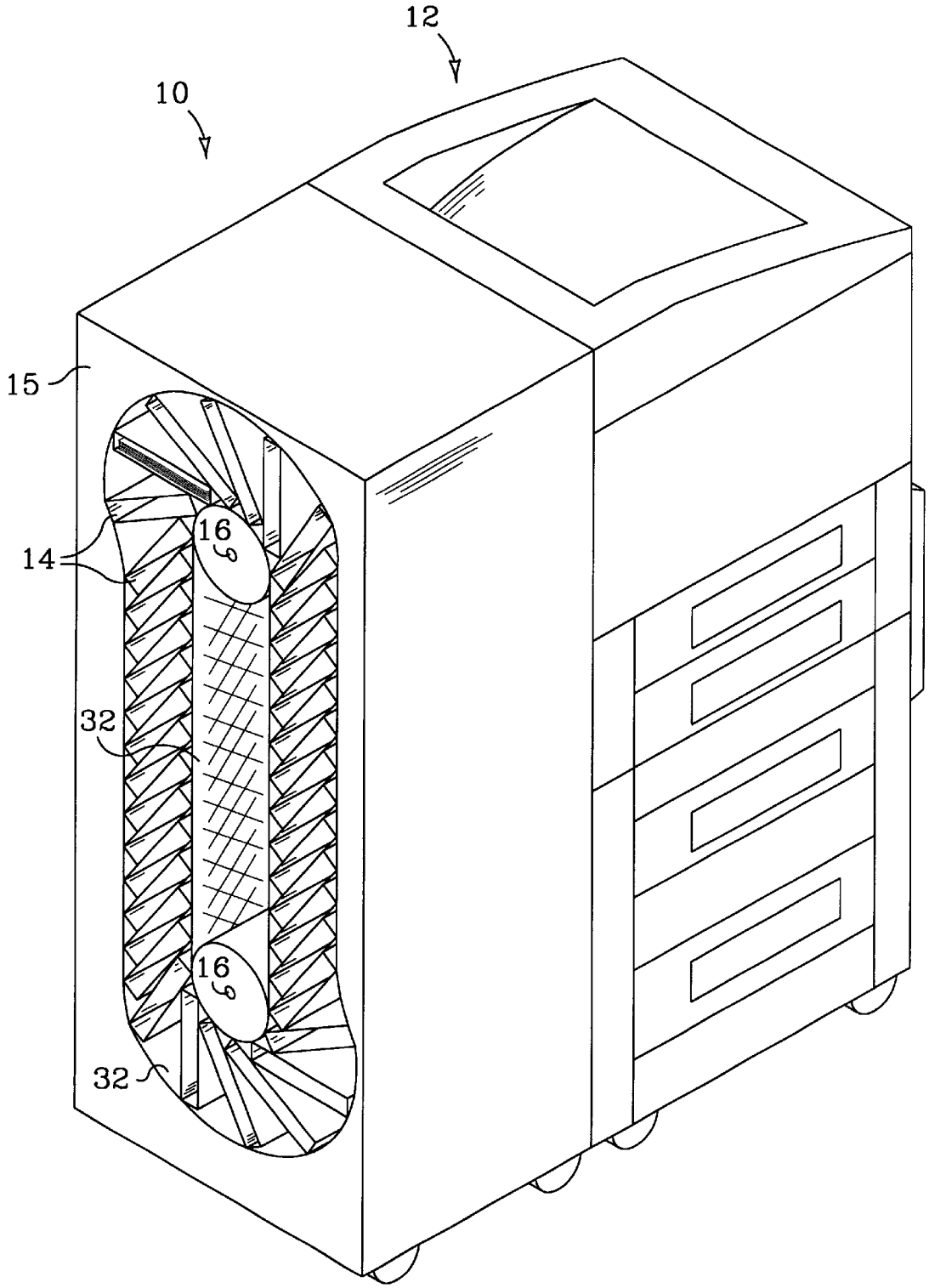
FIG. 9 is an isometric view of an alternative embodiment of the invented sorter in which the bins are arranged as an elongated carousel.

Referring to FIGS. 1–3, sorter 10 includes multiple paper bins 14 in housing 15. Bins 14 are arranged about an axis of rotation 16. In the arrangement shown in FIGS. 1 and 2, axis 16 runs parallel to the paper path and bins 14 are attached to and extend out from a circular drum 17 in the general configuration of a wheel. The wheel is designated by reference number 18 in the Figures. A hoop 19 may be used around the outside of bins 14 to provide additional structural support and paper control, as shown in FIG. 3. A stepper motor 20 drives drum 17 through a drive train 22 and, correspondingly, rotates bins 14 about axis 16. In an alternative configuration/geometry illustrated in FIG. 9, the wheel 16 is an elongated carousel type arrangement in which bins 14 are carried by a pair of belts 34 that rotate around drums 17 about axes 16.

Although other types of motors may be used, a stepper motor is desirable because it can function both as a source of motive power and as an indexing mechanism. Drive train 22 represents generally any suitable mechanism for transferring power from motor 20 to drum 18 including, for example, gears or belts. Drum 17 is mounted to housing 15 through a journaled shaft 23 or other suitable structural connection that allows drum 17 to rotate freely within housing 15. The point of rotation may be a shaft at the center of drum 17, as shown, or a bearing surface that allows rotation around the perimeter of drum 17, or through any other suitable structural configuration.

Each bin 14 is a rectangular box open at each end 24 and 26. The front end 24 of each bin faces printer 12. The back end 26 of one or more of the bins 14 is exposed at the rear of housing 15. Each bin 14 rotates through a sheet receiving position RP. In the sheet receiving position RP, each bin 14 is horizontal or near horizontal and aligned with paper discharge port 28 of printer 12. Other positions may be used to perform a variety of different operations. For example, finishing operations such as stacking, edge alignment, stapling, binding and hole punching could be performed at various bin positions. Bin position EA in FIG. 1 at the bottom of rotation shows a likely position for gravity based edge alignment. The completed documents are removed from back end 26 of bins 14.

Figure 4:
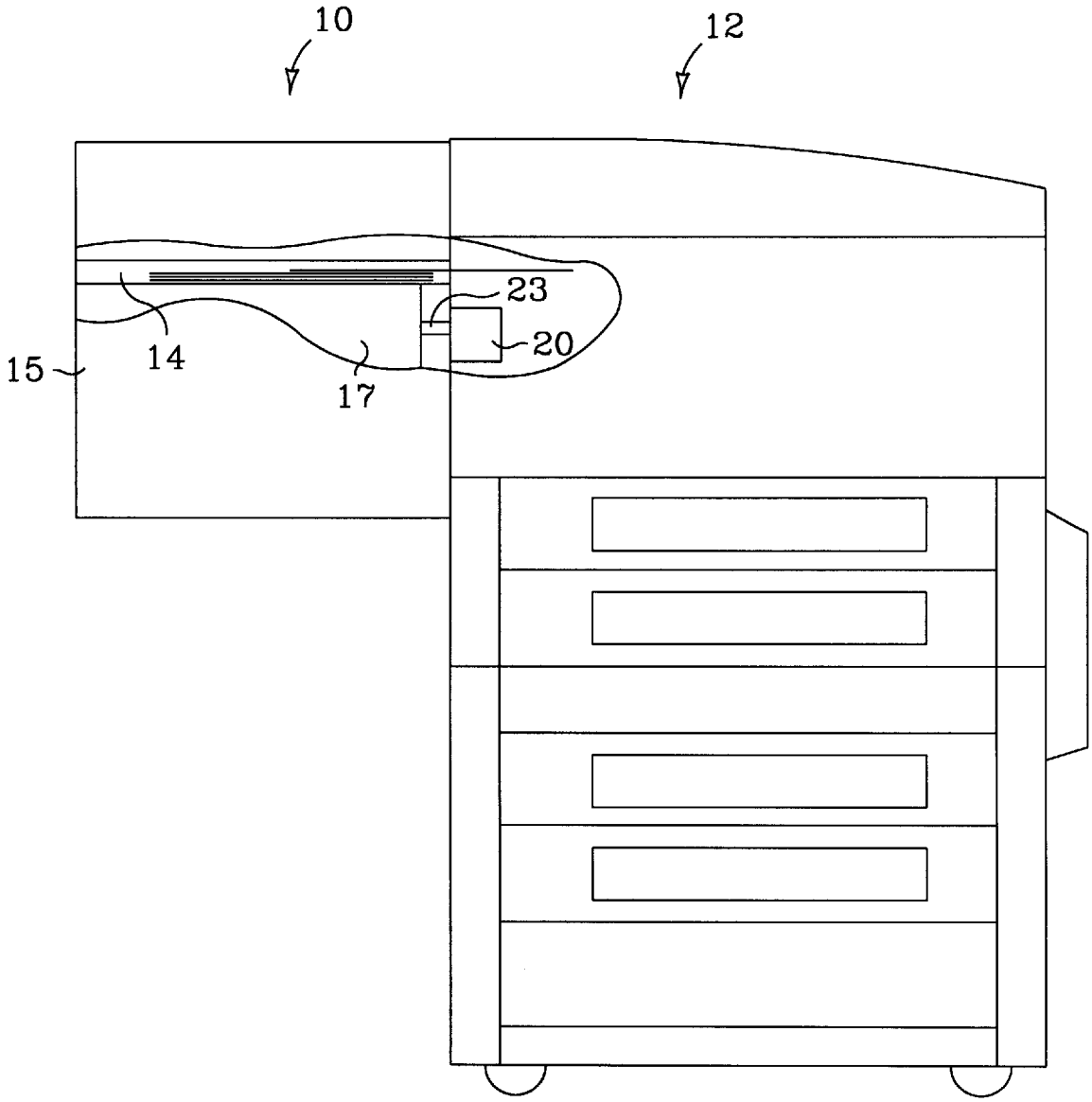
FIG. 4 is a front elevation view of a second embodiment of the invented rotary bin sorter in which the sorter is integrated into the printer such that some of the operational components of the sorter are built into printer.

In a second embodiment shown in FIG. 4, sorter 10 is integrated into printer 12 such that some of the operational components of sorter 10 are built into printer 12. Referring to FIG. 4, sorter housing 15 is mounted to the side of printer 12. Drum 17 extends into printer 12. Stepper motor 20, which rotates drum 17, is built in to printer 12. It may be desirable in this second embodiment to utilize an existing motor in printer 12 to also drive drum 18.

Figure 5:
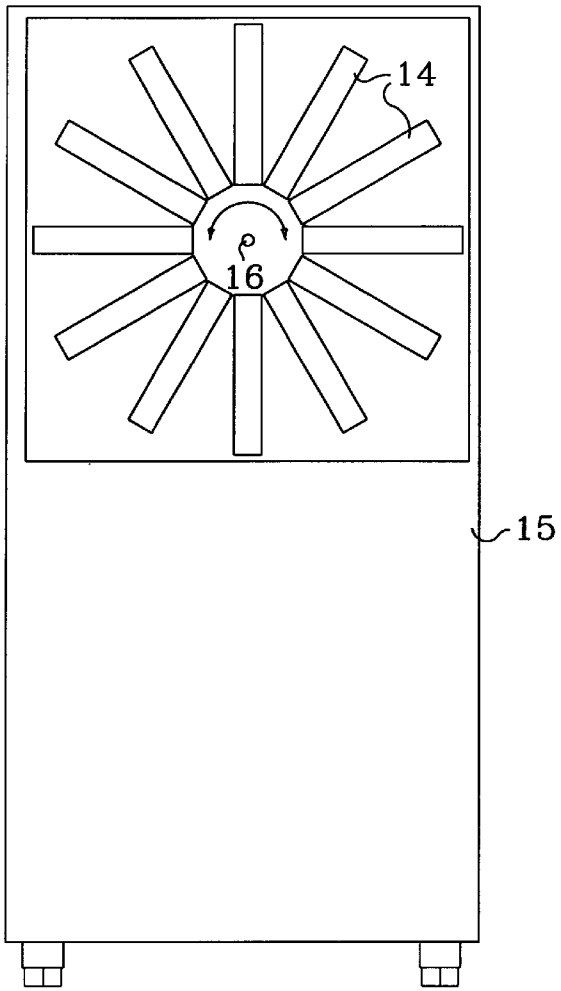
FIG. 5 is a side elevation view of a rotary sorter according to another embodiment of the invention in which the bins are arranged like spokes on a wheel projecting radially from the axis of rotation.
Figure 6:
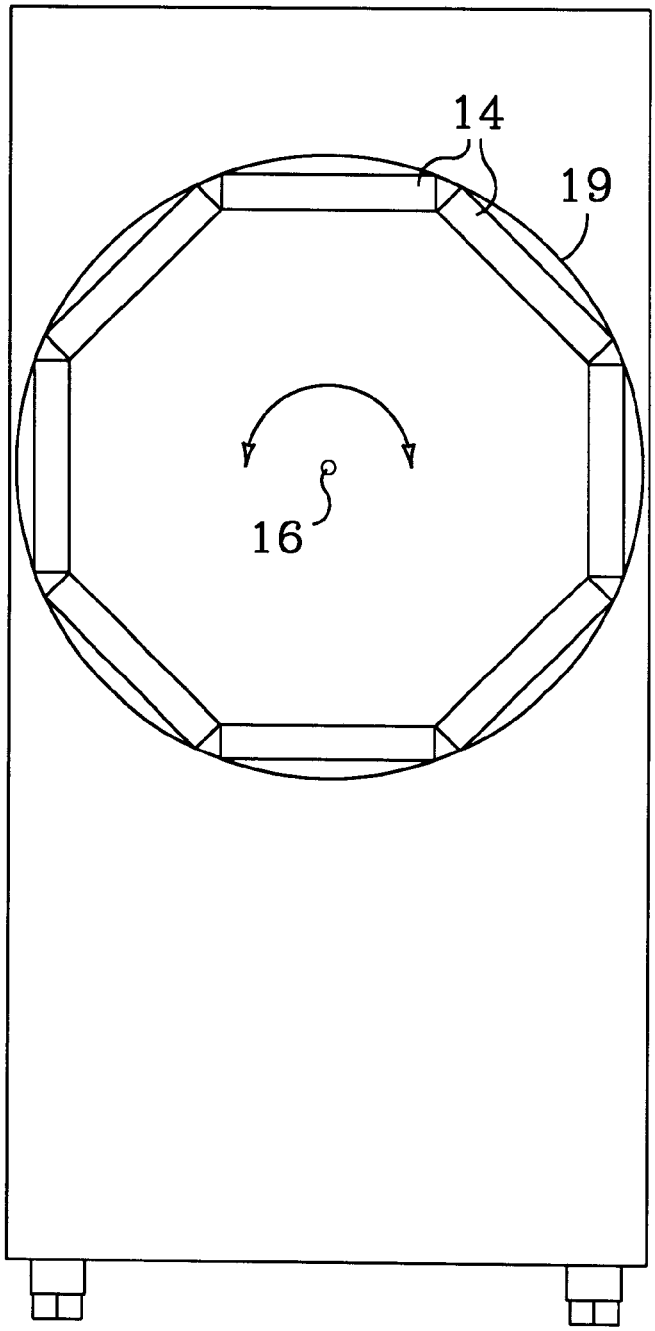
FIG. 6 is a side elevation view of a rotary sorter according to another embodiment of the invention in which the bins are arranged as chords near a circumferential perimeter around the axis of rotation.
Figure 7:
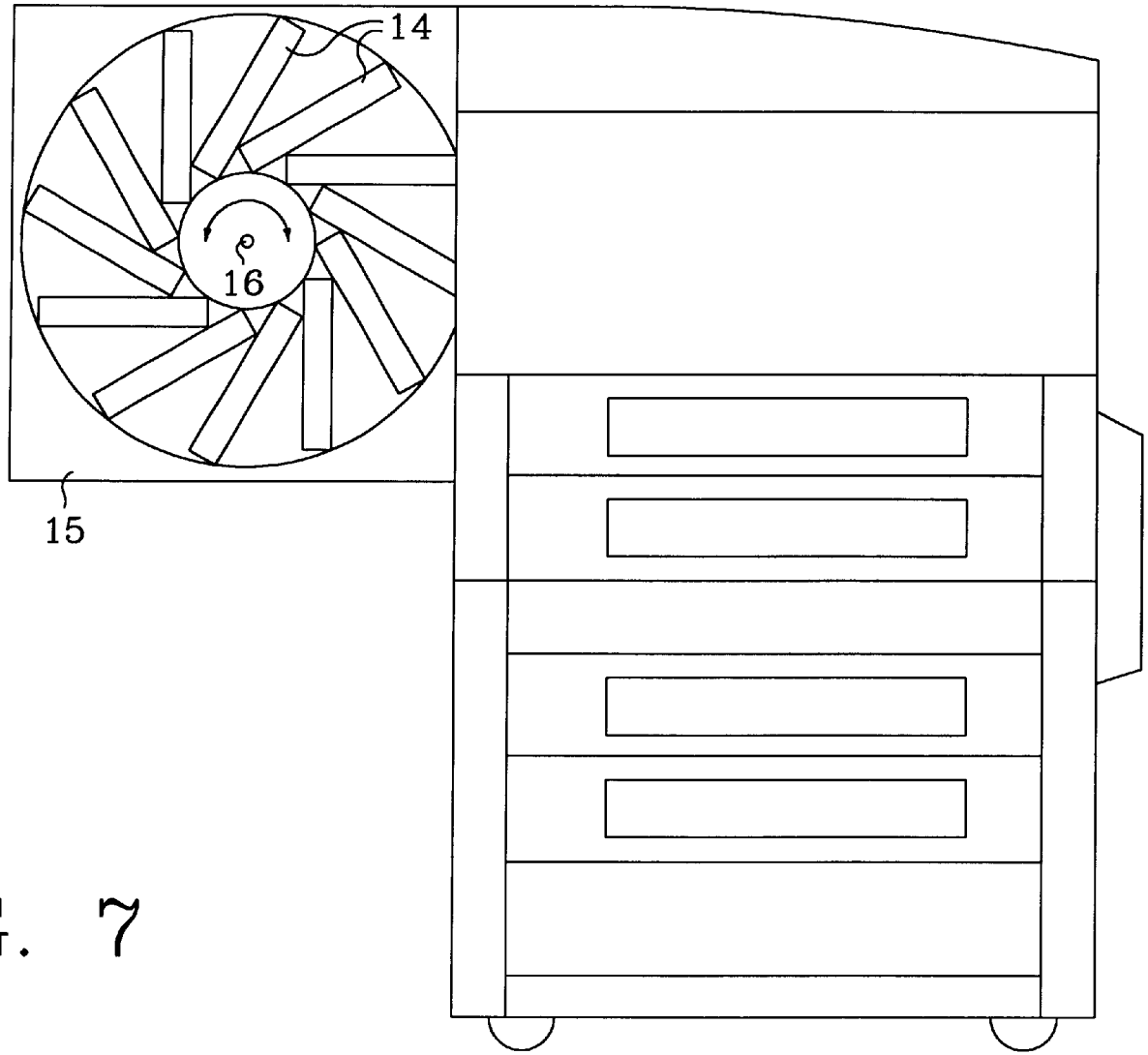
FIG. 7 is a front elevation view of a rotary sorter according to another embodiment of the invention in which the wheel of bins is oriented vertically but the axis of rotation runs perpendicular to the paper path.
Figure 8:
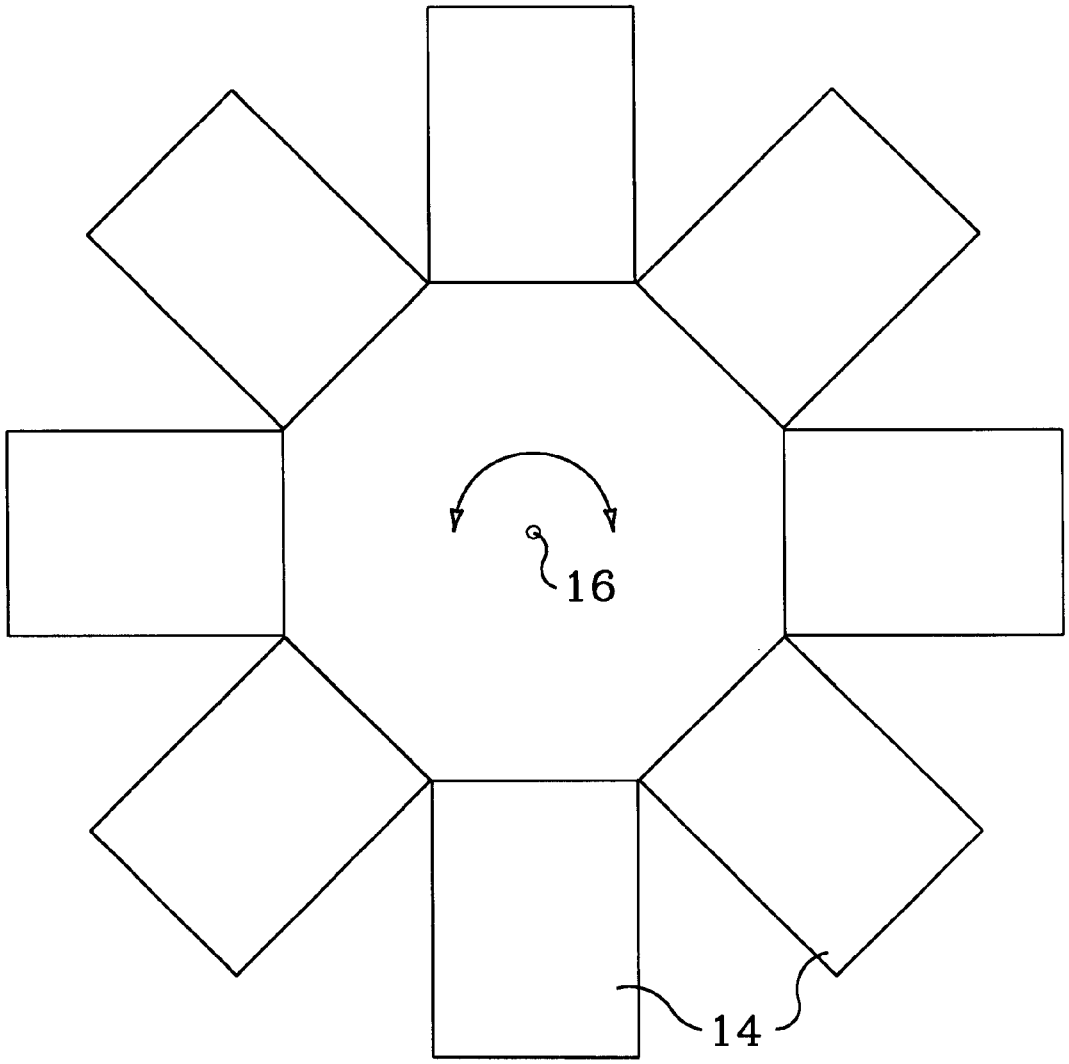
FIG. 8 is a plan view of a rotary sorter according to another embodiment of the invention the wheel of bins is oriented horizontally.

The invention may utilize various wheel configurations as necessary or desirable to accommodate a variety of different operating and environmental factors. In the configuration of FIG. 5, for example, bins 14 are arranged on drum 17 like spokes on a wheel projecting radially from axis of rotation 16. In the configuration of FIG. 6, bins 14 are arranged as chords near a circumferential perimeter defined by hoop 19. In the configuration of FIG. 7, wheel 18 is still oriented vertically but the axis of rotation 16 runs perpendicular to the paper path (rather than parallel to the paper path as in the earlier configurations). In this configuration, the front end 30 and side 32 of each bin are open. Front end 30 faces printer 12 to receive the sheets. The side 32 of one or more of the bins 14 is exposed at the front side of housing 15. In FIG. 8, wheel 18 is oriented horizontally. In this configuration, the broad side of bins 14 lie in the plane of the wheel 18 and only the front side 30 of each bin 14 needs to be open. The sheets are inserted in to and removed from open front side 30.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. A multiple bin sorter for use with an image forming device, the sorter comprising:

a plurality of rotatable bins configured to receive sheets output by the image forming device, each bin comprising a rectangular box open on at least one side;

the sheets being received into each bin through the open side;

the bins extending out from an axis of rotation in the general configuration of a wheel, each bin extending out from the axis along a line skewed to a line that extends radially out from the axis;

the bins arranged so that narrow sides of the bins lie in a plane of the wheel; and when the sorter is installed for use with an image forming device the wheel is oriented vertically and the axis of rotation extends in the same direction as the path of sheets output by the image forming device.

* * * * *